US006467377B1

(12) United States Patent
Kersting

(10) Patent No.: US 6,467,377 B1
(45) Date of Patent: Oct. 22, 2002

(54) PNEUMATIC STRIPPING MACHINE

(76) Inventor: Sven E. Kersting, 56 Endeavour Dr., Cambridge, On. (CA), N3C 4C2

( * ) Notice: Subject to any disclaimer, the term of this patent is extended or adjusted under 35 U.S.C. 154(b) by 0 days.

(21) Appl. No.: 09/765,599

(22) Filed: Jan. 22, 2001

(51) Int. Cl.[7] ..... E04D 15/00
(52) U.S. Cl. ..... 81/45
(58) Field of Search ..... 81/45, 46

(56) References Cited

U.S. PATENT DOCUMENTS

| | | | | | |
|---|---|---|---|---|---|
| 4,663,995 | A | * | 5/1987 | Amundson et al. | 81/45 |
| 4,691,439 | A | | 9/1987 | Marra | |
| 4,709,479 | A | | 12/1987 | Lavelette | |
| 4,858,503 | A | | 8/1989 | Dike, Jr. | |
| 5,001,946 | A | * | 3/1991 | Shirlin et al. | 81/45 |
| D327,206 | S | | 6/1992 | Johnson | |
| 5,741,047 | A | | 4/1998 | Ordonez | |
| 5,863,100 | A | | 1/1999 | Martin | |
| 5,906,145 | A | * | 5/1999 | Sheperd | 81/45 |
| 5,988,021 | A | * | 11/1999 | Nicolosi et al. | 81/45 |
| 6,095,015 | A | * | 8/2000 | Phelan | 81/45 |
| 6,116,117 | A | * | 9/2000 | Nicolosi et al. | 81/45 |

* cited by examiner

*Primary Examiner*—Joseph J. Hail, III
*Assistant Examiner*—Joni B. Danganan

(57) ABSTRACT

A pneumatic stripping machine for facilitating the removal of roofing shingles and flooring from a sub-straight. The pneumatic stripping machine includes a handle with an air inlet port adapted for coupling to a compressed air source, a shaft coupled to the handle, a shovel blade coupled to the lower end of the shaft, a pneumatic cylinder coupled to the shovel blade, an air hose assembly, and a stripping blade coupled to the pneumatic cylinder such that the stripping blade is selectively extendable relative to the shovel blade for facilitating the removal of tiles and shingles.

17 Claims, 2 Drawing Sheets

PNEUMATIC STRIPPING MACHINE

BACKGROUND OF THE INVENTION

1. Field of the Invention

The present invention relates to stripping machines and more particularly pertains to a new pneumatic stripping machine for facilitating the removal of roofing shingles and flooring from a sub-straight.

2. Description of the Prior Art

The use of stripping machines is known in the prior art. More specifically, stripping machines heretofore devised and utilized are known to consist basically of familiar, expected and obvious structural configurations, notwithstanding the myriad of designs encompassed by the crowded prior art which have been developed for the fulfillment of countless objectives and requirements. Known prior art includes U.S. Pat. No. 4,858,503; U.S. Pat. No. 5,741,047; U.S. Pat. No. 4,691,439; U.S. Pat. No. 4,709,479; U.S. Pat. No. 5,863,100; and U.S. Pat. No. Des. 3 27,206.

While these devices fulfill their respective, particular objectives and requirements, the aforementioned patents do not disclose a new pneumatic stripping machine. The inventive device includes a handle with an air inlet port adapted for coupling to a compressed air source, a shaft coupled to the handle, a shovel blade coupled to the lower end of the shaft, a pneumatic cylinder coupled to the shovel blade, an air hose assembly, and a stripping blade coupled to the pneumatic cylinder such that the stripping blade is selectively extendable relative to the shovel blade for facilitating the removal of tiles and shingles.

In these respects, the pneumatic stripping machine according to the present invention substantially departs from the conventional concepts and designs of the prior art, and in so doing provides an apparatus primarily developed for the purpose of facilitating the removal of roofing shingles and flooring from a sub-straight.

SUMMARY OF THE INVENTION

In view of the foregoing disadvantages inherent in the known types of stripping machines now present in the prior art, the present invention provides a new pneumatic stripping machine construction wherein the same can be utilized for facilitating the removal of roofing shingles and flooring from a sub-straight.

The general purpose of the present invention, which will be described subsequently in greater detail, is to provide a new pneumatic stripping machine apparatus and method which has many of the advantages of the stripping machines mentioned heretofore and many novel features that result in a new pneumatic stripping machine which is not anticipated, rendered obvious, suggested, or even implied by any of the prior art stripping machines, either alone or in any combination thereof.

To attain this, the present invention generally comprises a handle with an air inlet port adapted for coupling to a compressed air source, a shaft coupled to the handle, a shovel blade coupled to the lower end of the shaft, a pneumatic cylinder coupled to the shovel blade, an air hose assembly, and a stripping blade coupled to the pneumatic cylinder such that the stripping blade is selectively extendable relative to the shovel blade for facilitating the removal of tiles and shingles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pneumatic stripping machine apparatus and method which has many of the advantages of the stripping machines mentioned heretofore and many novel features that result in a new pneumatic stripping machine which is not anticipated, rendered obvious, suggested, or even implied by any of the prior art stripping machines, either alone or in any combination thereof.

It is another object of the present invention to provide a new pneumatic stripping machine which may be easily and efficiently manufactured and marketed.

It is a further object of the present invention to provide a new pneumatic stripping machine which is of a durable and reliable construction.

An even further object of the present invention is to provide a new pneumatic stripping machine which is susceptible of a low cost of manufacture with regard to both materials and labor, and which accordingly is then susceptible of low prices of sale to the consuming public, thereby making such pneumatic stripping machine economically available to the buying public.

Still yet another object of the present invention is to provide a new pneumatic stripping machine which provides in the apparatuses and methods of the prior art some of the advantages thereof, while simultaneously overcoming some of the disadvantages normally associated therewith.

Still another object of the present invention is to provide a new pneumatic stripping machine for facilitating the removal of roofing shingles and flooring from a sub-straight.

Yet another object of the present invention is to provide a new pneumatic stripping machine which includes a handle with an air inlet port adapted for coupling to a compressed air source, a shaft coupled to the handle, a shovel blade coupled to the lower end of the shaft, a pneumatic cylinder coupled to the shovel blade, an air hose assembly, and a stripping blade coupled to the pneumatic cylinder such that the stripping blade is selectively extendable relative to the shovel blade for facilitating the removal of tiles and shingles.

Still yet another object of the present invention is to provide a new pneumatic stripping machine that has a compact form factor increasing the maneuverability of the machine.

Even still another object of the present invention is to provide a new pneumatic stripping machine that reduces the potential for injury by reducing the repetitive operations necessary to remove shingles and flooring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
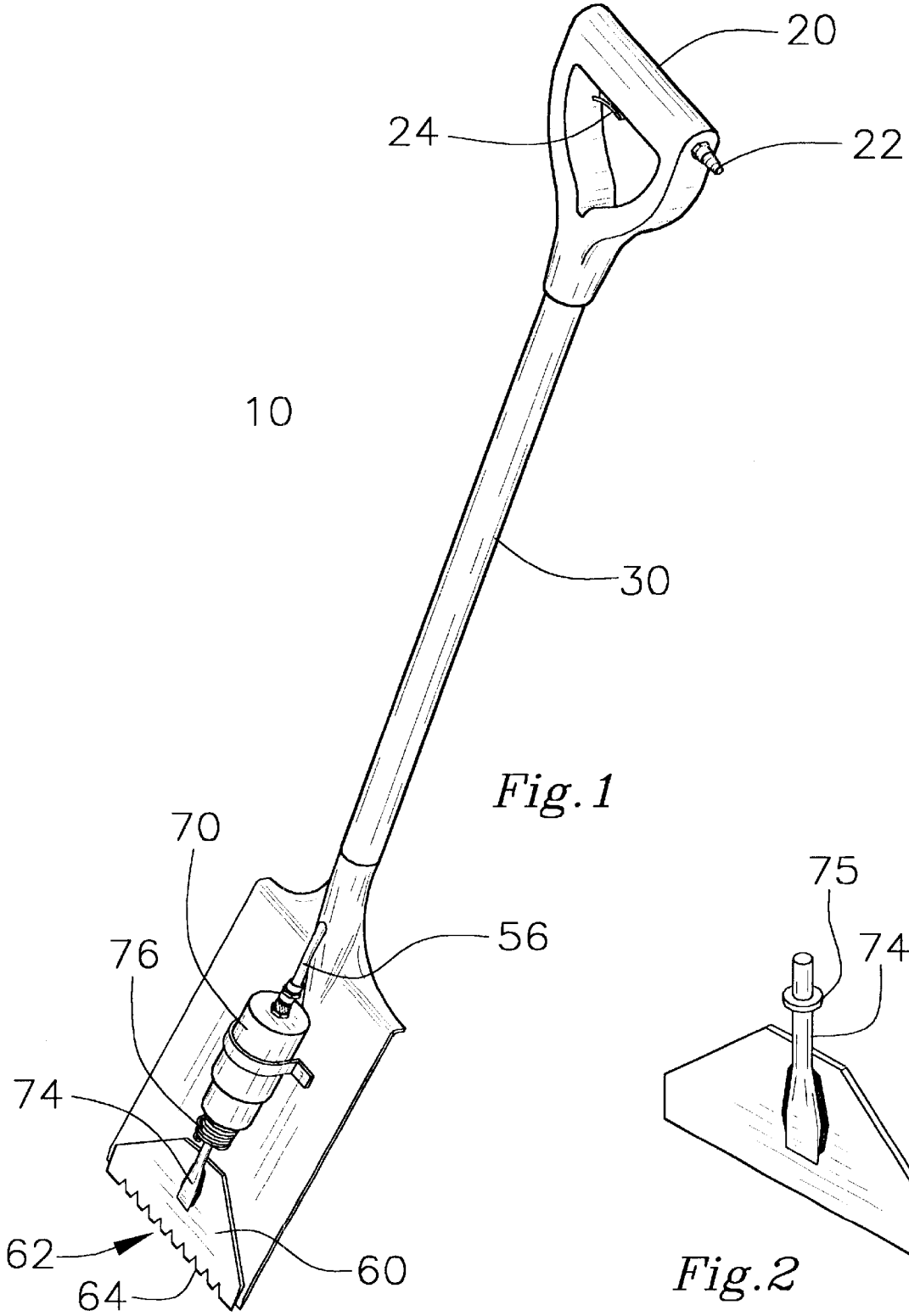
FIG. 1 is a schematic perspective view of a new pneumatic stripping machine according to the present invention.
Figure 2:
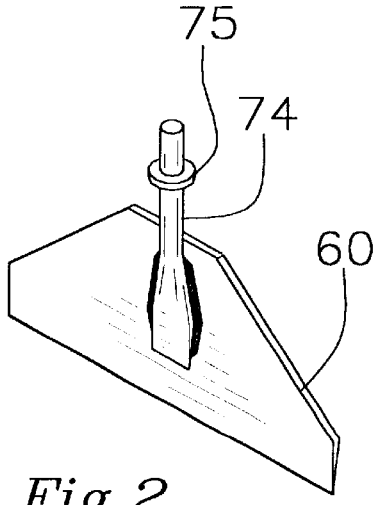
FIG. 2 is a schematic detail view of the stripping blade of the present invention.
Figure 3:
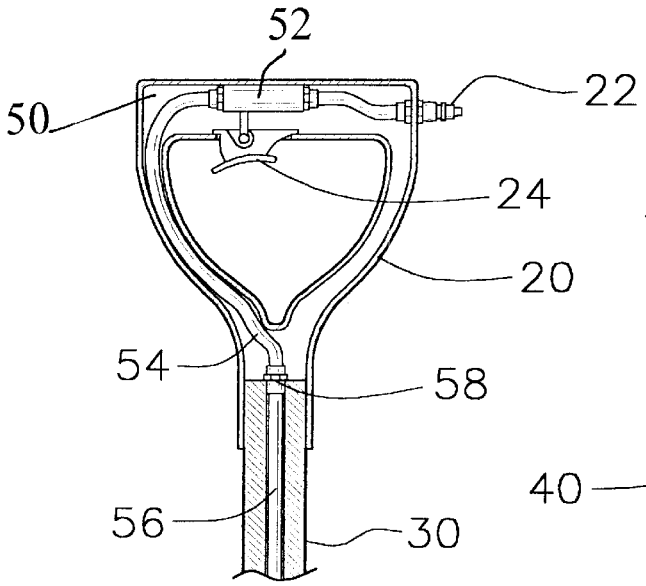
FIG. 3 is a schematic interior view of the handle portion of the present invention.
Figure 4:
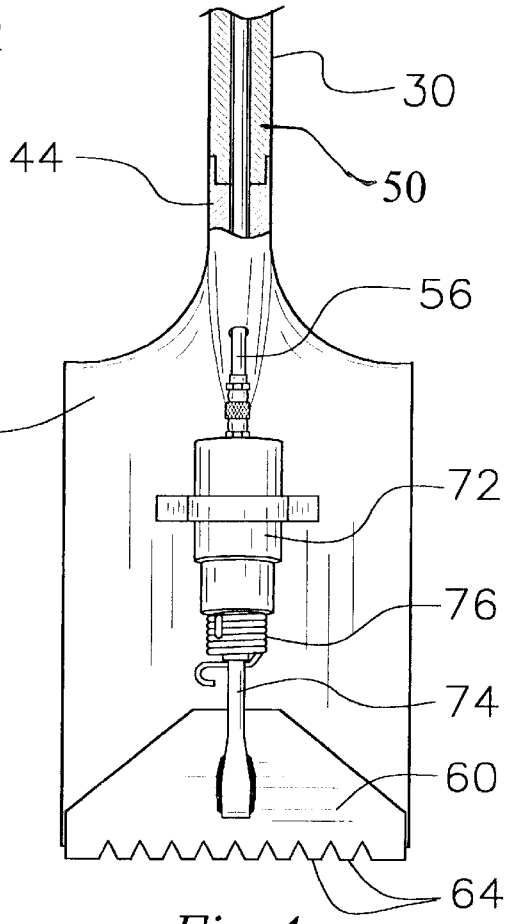
FIG. 4 is a schematic front view of the shovel blade and stripping blade of the present invention.
Figure 5:
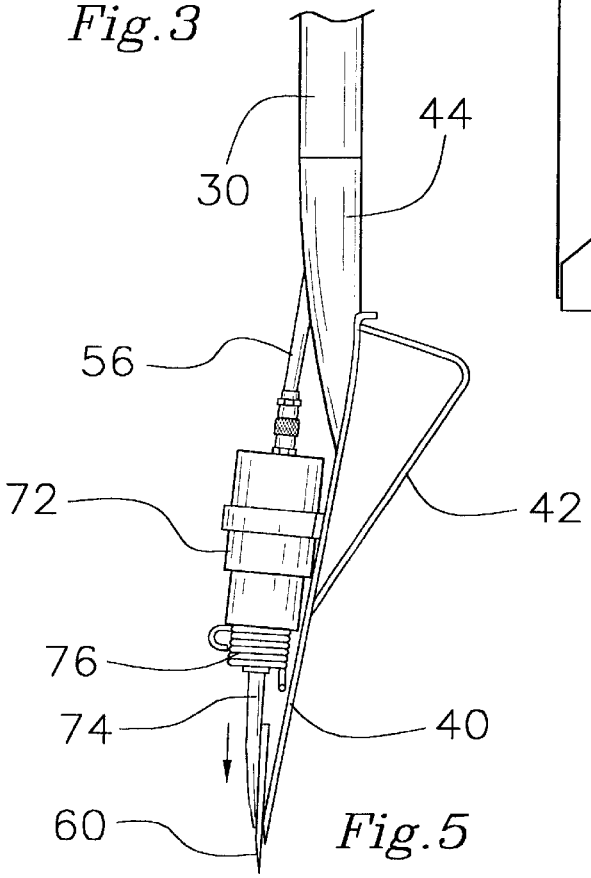
FIG. 5 is a schematic side view of the present invention.

With reference now to the drawings, and in particular to FIGS. 1 through 5 thereof, a new pneumatic stripping machine embodying the principles and concepts of the present invention and generally designated by the reference numeral 10 will be described.

As best illustrated in FIGS. 1 through 5, the pneumatic stripping machine 10 generally comprises a handle 20, a shaft 30, a shovel blade 40, a pneumatic cylinder 70, an air hose assembly 50, and a stripping blade 60. The handle 20 includes an air inlet port 22 designed for coupling to a compressed air source. The upper end of the shaft 30 is coupled to the handle 20. The shovel blade 40 is coupled to a lower end of the shaft 30. The pneumatic cylinder 70 is coupled to the shovel blade 40.

The air hose assembly 50 extends through the handle 20 and the shaft 30. A first end of the air hose assembly 50 is coupled to the air inlet port 22. A second end of the air hose assembly 50 is coupled to the pneumatic cylinder 70 for providing compressed air to the cylinder 70.

The stripping blade 60 is coupled to the pneumatic cylinder 70 such that the stripping blade 60 is selectively extendable relative to the shovel blade 40 for facilitating removal of tiles and shingles.

The air hose assembly 50 includes a valve 52 for facilitating selective activation of the pneumatic cylinder 70.

A trigger 24 is coupled to the handle 20. The trigger 24 is operationally coupled to the valve 52 for facilitating opening of the valve 52 thus compressed air is provided to the pneumatic cylinder 70.

A wedge member 42 is coupled to the shovel blade 40. The wedge member 42 is positioned such that the wedge member 42 is designed for receiving a foot of a user for increasing leverage on the shovel blade 40 during use.

The stripping blade 60 includes a serrated distal edge 62 for facilitating removal of tiles and shingles. In an embodiment, the blade may include a straight edge.

The pneumatic cylinder 70 includes a main body portion 72 and a rod 74 extending from the main body portion 72. The rod 74 includes a flattened head portion. A broad face of the flattened head portion is fixedly coupled to the stripping blade 60.

A medial portion of the rod 74 includes a lip portion 75 which extends outwardly from the rod 74.

A spring 76 is coupled between the lip portion 75 of the rod 74 and the main portion 72 of the pneumatic cylinder 70 thus the spring 76 biases the rod 74 back towards the pneumatic cylinder 70 after the rod 74 has been extended from the main portion 72 by the compressed air passing through the pneumatic cylinder 70.

The handle 20 includes a lower opening for receiving the upper end of the shaft 30.

The air hose assembly 50 includes a first air hose 54 positioned in an interior space of the handle 20. The first air hose 54 includes a first end coupled to the air inlet port 22. The first air hose 54 includes a second end couplable to a hose connector 58 coupled to the upper end of the shaft 30.

The air hose assembly 50 includes a second air hose 56 positioned substantially in an interior space of the shaft 30. The second air hose 56 includes a first end coupled to the hose connector 58 thus the second air hose 56 is in environmental communication with the first air hose 54 when the first 54 and second air hoses 56 are coupled to the hose connector 58. The second air hose 56 includes a second end coupled to the pneumatic cylinder 70.

The second end of the second air hose 56 extends out of the lower end of the shaft 30.

The shovel blade 40 includes a connection portion 44 couplable to the lower end of the shaft 30. The connection portion 44 of the shovel blade 40 includes an air hose conduit. The second end of the air hose extends through the air hose conduit.

The serrated stripping blade 60 includes a plurality of teeth 64. Each of the teeth 64 includes a straight distal edge. The straight distal edges of the teeth 64 are aligned with respect to each other for facilitating removal of tiles and shingles.

In use, the pneumatic stripping machine is positioned next to the material to be removed in such a manner that the edge of the stripping blade is underneath the material to be removed. The user places a foot on the wedge member and applies pressure to the pneumatic stripping machine. The user then activates the pneumatic stripping machine by depressing the trigger. The pneumatic action of the machine then repeatedly thrusts the stripping blade forward, thus lifting the material to be removed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pneumatic stripping machine comprising:

a handle, said handle having an air inlet port adapted for coupling to a compressed air source;

a shaft, an upper end of said shaft being coupled to said handle;

a shovel blade coupled to a lower end of said shaft;

a pneumatic cylinder coupled to said shovel blade;

an air hose assembly extending through said handle and said shaft, a first end of said air hose assembly being coupled to said air inlet port, a second end of said air hose assembly being coupled to said pneumatic cylinder for providing compressed air to said cylinder; and a stripping blade coupled to said pneumatic cylinder such that said stripping blade is selectively extendable relative to said shovel blade for facilitating removal of tiles and shingles;

said pneumatic cylinder including a main body portion and a rod extending from said main body portion, said rod having a flattened head portion, a broad face of said flattened head portion being fixedly coupled to said stripping blade.

2. The pneumatic stripping machine of claim 1, further comprising:

said air hose assembly including a valve for facilitating selective activation of said pneumatic cylinder; and a trigger coupled to said handle, said trigger being operationally coupled to said valve for facilitating opening of said valve whereby compressed air is provided to said pneumatic cylinder.

3. The pneumatic stripping machine of claim 1, further comprising:

a wedge member coupled to said shovel blade, said wedge member being positioned such that said wedge member is adapted for receiving a foot of a user for increasing leverage on said shovel blade during use.

4. The pneumatic stripping machine of claim 1, further comprising:

said stripping blade having a serrated distal edge for facilitating removal of tiles and shingles.

5. The pneumatic stripping machine of claim 4, further comprising:

said serrated stripping blade having a plurality of teeth, each of said teeth having a straight distal edge, said straight distal edges of said teeth being aligned with respect to each other for facilitating removal of tiles and shingles.

6. The pneumatic stripping machine of claim 1, further comprising:

said handle having a lower opening for receiving said upper end of said shaft; and said air hose assembly including a first air hose positioned in an interior space of said handle, said first air hose having a first end coupled to said air inlet port, said first air hose having a second end couplable to a hose connector coupled to said upper end of said shaft.

7. The pneumatic stripping machine of claim 6, further comprising:

said air hose assembly including a second air hose positioned substantially in an interior space of said shaft, said second air hose having a first end coupled to said hose connector whereby said second air hose is in environmental communication with said first air hose when said first and second air hoses are coupled to said hose connector, said second air hose having a second end coupled to said pneumatic cylinder.

8. The pneumatic stripping machine of claim 7, further comprising:

said second end of said second air hose extending out of said lower end of said shaft; and said shovel blade having a connection portion couplable to said lower end of said shaft, said connection portion of said shovel blade including an air hose conduit, said second end of said air hose extending through said air hose conduit.

9. A pneumatic stripping machine comprising:

a handle, said handle having an air inlet port adapted for coupling to a compressed air source;

a shaft, an upper end of said shaft being coupled to said handle;

a shovel blade coupled to a lower end of said shaft;

a pneumatic cylinder coupled to said shovel blade;

an air hose assembly extending through said handle and said shaft, a first end of said air hose assembly being coupled to said air inlet port, a second end of said air hose assembly being coupled to said pneumatic cylinder for providing compressed air to said cylinder;

a stripping blade coupled to said pneumatic cylinder such that said stripping blade is selectively extendable relative to said shovel blade for facilitating removal of tiles and shingles;

said pneumatic cylinder including a main body portion and a rod extending from said main body portion, a medial portion of said rod having a lip portion extending outwardly from said rod;

a spring coupled between said lip portion of said rod and said main portion of said pneumatic cylinder whereby said spring biases said rod back towards said pneumatic cylinder after said rod has been extended from said main portion by the compressed air passing through said pneumatic cylinder.

10. The pneumatic stripping machine of claim 9, further comprising:

said air hose assembly including a valve for facilitating selective activation of said pneumatic cylinder; and a trigger coupled to said handle, said trigger being operationally coupled to said valve for facilitating opening of said valve whereby compressed air is provided to said pneumatic cylinder.

11. The pneumatic stripping machine of claim 9, further comprising:

a wedge member coupled to said shovel blade, said wedge member being positioned such that said wedge member is adapted for receiving a foot of a user for increasing leverage on said shovel blade during use.

12. The pneumatic stripping machine of claim 9, further comprising:

said stripping blade having a serrated distal edge for facilitating removal of tiles and shingles.

13. The pneumatic stripping machine of claim 12, further comprising:

said serrated stripping blade having a plurality of teeth, each of said teeth having a straight distal edge, said straight distal edges of said teeth being aligned with respect to each other for facilitating removal of tiles and shingles.

14. The pneumatic stripping machine of claim 9, further comprising:

said handle having a lower opening for receiving said upper end of said shaft; and said air hose assembly including a first air hose positioned in an interior space of said handle, said first air hose having a first end coupled to said air inlet port, said first air hose having a second end couplable to a hose connector coupled to said upper end of said shaft.

15. The pneumatic stripping machine of claim 14, further comprising:

said air hose assembly including a second air hose positioned substantially in an interior space of said shaft, said second air hose having a first end coupled to said hose connector whereby said second air hose is in environmental communication with said first air hose when said first and second air hoses are coupled to said hose connector, said second air hose having a second end coupled to said pneumatic cylinder.

16. The pneumatic stripping machine of claim 15, further comprising:

said second end of said second air hose extending out of said lower end of said shaft; and said shovel blade having a connection portion couplable to said lower end of said shaft, said connection portion of said shovel blade including an air hose conduit, said second end of said air hose extending through said air hose conduit.

17. A pneumatic stripping machine comprising:

a handle, said handle having an air inlet port adapted for coupling to a compressed air source;

a shaft, an upper end of said shaft being coupled to said handle;

a shovel blade coupled to a lower end of said shaft;

a pneumatic cylinder coupled to said shovel blade;

an air hose assembly extending through said handle and said shaft, a first end of said air hose assembly being coupled to said air inlet port, a second end of said air hose assembly being coupled to said pneumatic cylinder for providing compressed air to said cylinder;

a stripping blade coupled to said pneumatic cylinder such that said stripping blade is selectively extendable relative to said shovel blade for facilitating removal of tiles and shingles;

said air hose assembly including a valve for facilitating selective activation of said pneumatic cylinder;

a trigger coupled to said handle, said trigger being operationally coupled to said valve for facilitating opening of said valve whereby compressed air is provided to said pneumatic cylinder;

a wedge member coupled to said shovel blade, said wedge member being positioned such that said wedge member is adapted for receiving a foot of a user for increasing leverage on said shovel blade during use;

said stripping blade having a serrated distal edge for facilitating removal of tiles and shingles;

said pneumatic cylinder including a main body portion and a rod extending from said main body portion, said rod having a flattened head portion, a broad face of said flattened head portion being fixedly coupled to said stripping blade;

a medial portion of said rod having a lip portion extending outwardly from said rod;

a spring coupled between said lip portion of said rod and said main portion of said pneumatic cylinder whereby said spring biases said rod back towards said pneumatic cylinder after said rod has been extended from said main portion by the compressed air passing through said pneumatic cylinder;

said handle having a lower opening for receiving said upper end of said shaft;

said air hose assembly including a first air hose positioned in an interior space of said handle, said first air hose having a first end coupled to said air inlet port, said first air hose having a second end couplable to a hose connector coupled to said upper end of said shaft;

said air hose assembly including a second air hose positioned substantially in an interior space of said shaft, said second air hose having a first end coupled to said hose connector whereby said second air hose is in environmental communication with said first air hose when said first and second air hoses are coupled to said hose connector, said second air hose having a second end coupled to said pneumatic cylinder;

said second end of said second air hose extending out of said lower end of said shaft;

said shovel blade having a connection portion couplable to said lower end of said shaft, said connection portion of said shovel blade including an air hose conduit, said second end of said air hose extending through said air hose conduit; and said serrated stripping blade having a plurality of teeth, each of said teeth having a straight distal edge, said straight distal edges of said teeth being aligned with respect to each other for facilitating removal of tiles and shingles.

* * * * *